US005113048A

United States Patent [19]

Lafferty

[11] Patent Number: 5,113,048

[45] Date of Patent: May 12, 1992

[54] PNEUMATICALLY ACTUATED HOSPITAL SIGNALING DEVICE

[75] Inventor: William G. Lafferty, Deephaven, Minn.

[73] Assignee: Crest Electronics, Dassel, Minn.

[21] Appl. No.: 451,336

[22] Filed: Dec. 15, 1989

[51] Int. Cl.[5] ..... H01H 35/24

[52] U.S. Cl. ..... 200/83 Z; 200/81 H

[58] Field of Search ..... 200/81.9, 83 Z, 81 R, 200/81 H, 81.6

[56] References Cited

U.S. PATENT DOCUMENTS 2,875,291 2/1959 Armstrong et al. ..... 200/81.9 R
4,461,181 7/1984 North, Jr. ..... 200/81.6 X
4,754,107 6/1988 Tracey ..... 200/83 Z

FOREIGN PATENT DOCUMENTS 1409777 6/1964 France ..... 200/83 Z
262429 6/1968 Switzerland ..... 200/81.9 R

*Primary Examiner*—J. R. Scott
*Attorney, Agent, or Firm*—Dorsey & Whitney

[57] ABSTRACT

A positionally neutral, liquid tight signaling device includes an electrical contact switch remotely actuated by a pneumatic squeeze bulb. A gas permeable, flexible diaphragm divides the internal chamber of the signaling device into a switching portion and an isolated actuating portion. First and second electrical contacts within the switching portion are biased into an open circuit position by a compression spring. The selective collapsing of the squeeze bulb creates an overpressure in the actuating portion of the internal chamber, collapsing the diaphragm and shifting the two electrical contacts into abutting, electrically conducting relationship.

5 Claims, 1 Drawing Sheet

PNEUMATICALLY ACTUATED HOSPITAL SIGNALING DEVICE

TECHNICAL FIELD

The disclosed invention pertains to pneumatically actuated signaling devices. In particular, it relates to patient operated signaling devices suitable for use in oxygen rich hospital room and other health care related environments.

BACKGROUND

Hospital rooms and the like are universally equipped with patient signaling devices that allow a patient, with a minimum of effort, to signal a centralized nurse station or the like when assistance is required. Such signaling systems typically, and preferably, comprise electrically powered networks that allow the patient to signal the central station by actuating an electrical switch. A display panel at the central station indicates which patient, in which room, is signaling for assistance. The electrical current carrying portions of the network, however, must be isolated from the patient. As will be readily appreciated, the use of an electrical switch, in proximity to a patient requiring an oxygen rich environment, presents the twin hazards of explosion and fire.

U.S. Pat. No. 3,823,285, entitled Pneumatically Actuated Switching Device With Ball Contact Means, discloses a pneumatically actuated signaling device that provides for the remotely actuated, selective closing of an electrical contact switch by a patient. The switching device disclosed in the '285 patent includes a deformable bulb, squeezeable by a patient, that is connected to an electrical switching means by a hollow pneumatic tube. The electrical switching means comprises an electrically conducting, metal ball that is shiftably carried within a tubular sleeve. Collapsing the bulb causes an increase of air pressure that pushes the ball to a different position within the sleeve to complete an electrical contact.

The pneumatically actuated switching device disclosed in the '285 Dwyer patent relies on gravity to bias the shiftable, electrically conducting metal ball into its unactuated position. Moreover, the chamber which holds the shiftable ball must be vented to atmosphere to allow for free movement of the ball within the chamber. Accordingly, the switch can only operate when it is oriented in its proper, upright position, and the switch cannot be submersed in cleaning fluid when cleaning and/or, sterilization of the switch is required.

SUMMARY OF THE INVENTION

The pneumatically actuated signaling device in accordance with the present invention is specifically designed to allow for the remote actuation of an electrical contact switch in a signaling device that is positionally neutral and which can be submersed in a cleaning and sterilizing fluid. The signaling device hereof comprises a liquid tight chamber separated into a switch portion and an actuating portion by a gas permeable, flexible diaphragm. First and second electrical contacts are received within the switch portion of the chamber, and are urged into a non-contacting relationship by a biasing spring.

The actuating portion of the chamber includes a deformable bulb that may be selectively collapsed by a patient. Collapsing the bulb provides an overpressure that acts against the flexible diaphragm to push the first and second electrical contacts into contacting relationship against the urging of the biasing spring.

The isolation of the actuating portion of the chamber from the switch portion of the chamber by the diaphragm allows for shifting of the diaphragm with only a slight overpressure created by the squeezeable bulb. Accordingly, the switching portion of the chamber need not be vented to atmosphere, and can be made liquid tight for immersion in a cleaning and/or sterilizing fluid. The gas permeable membrane construction of the diaphragm, however, allows for equalization of pressure between the actuating portion and switching portion of the signaling device chamber over time.

DETAILED DESCRIPTION OF THE DRAWINGS

Figures 1, 2:
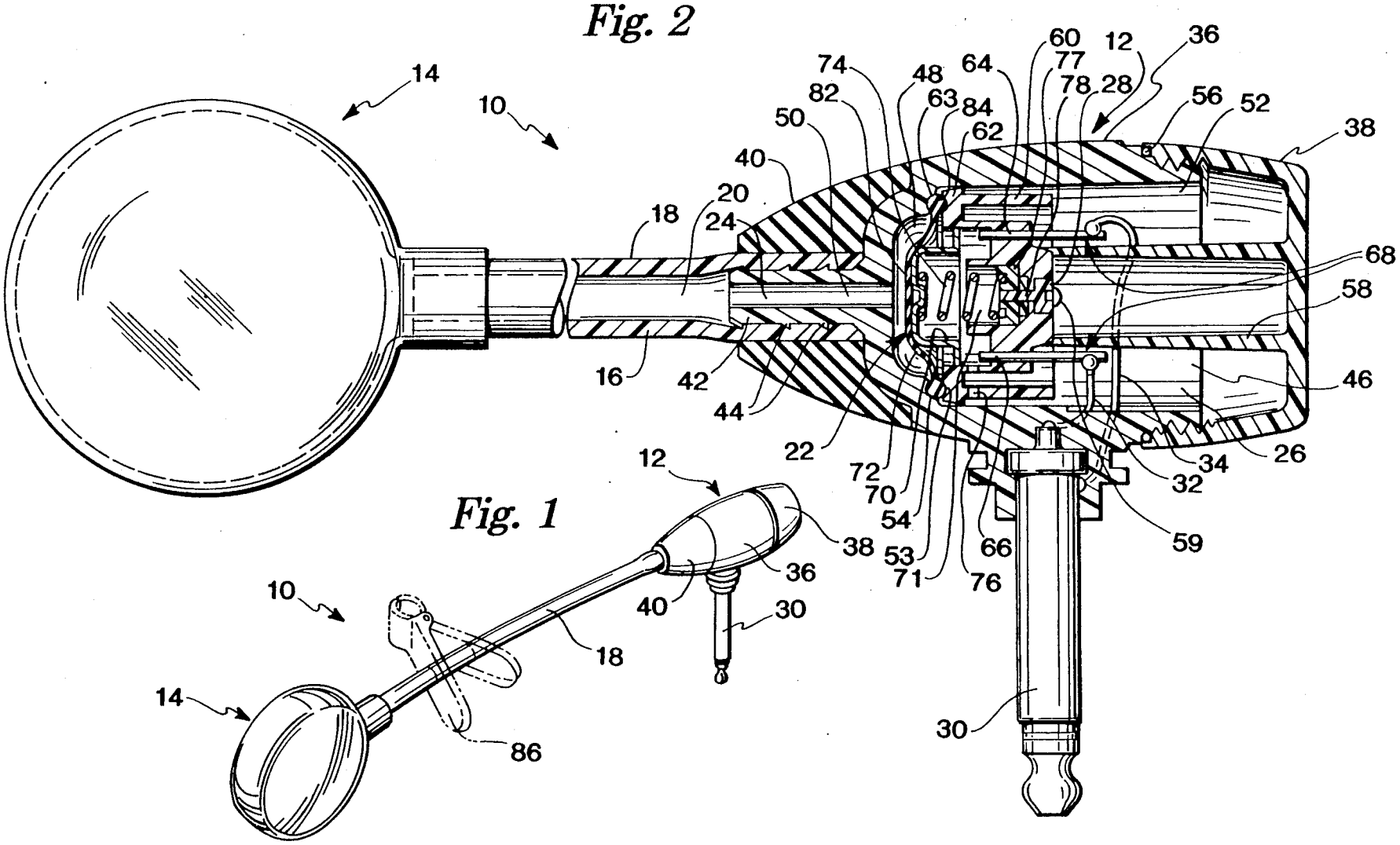
FIG. 1 is a perspective view of the signaling device in accordance with the present invention; and, FIG. 2 is a side, elevational view of the signaling device with the switch casing of the signaling device shown in cross-section.

Referring to the drawing, the pneumatically actuated signaling device 10 in accordance with the present invention broadly includes switch casing 12, deformable squeeze bulb 14, and pneumatic tubing 16 extending between the switch casing 12 and the squeeze bulb 14. The switch casing 12, squeeze bulb 14, and tubing 16 present a device body 18 that defines a liquid tight chamber 20. Flexible diaphragm 22 divides and isolates the liquid tight chamber 20 into an actuating portion 24 and a switching portion 26. Electrical switch 28 is received within the switch casing 12, and is electrically connected to a plug 30 by wire leads 32, 34.

Switch casing 12 includes central portion 36, threadable cap 38, and strain relief neck 40. Plug 30 is fixably retained within the central portion 36 in a fluid tight fit. A tube fitting 42 extends axially outwardly from the central portion 36, and includes annular barbs 44 for securely retaining the tubing 16. Central portion 36 of switch casing 12 defines a central cavity 46. Central cavity 46 includes a diaphragm receiving portion 48 that is in fluid communication with the central channel 50 of tube fitting 42. Central cavity 46 also includes a switch receiving portion 52, having a diameter larger than the diameter of the diaphragm receiving portion 48. The junction of the diaphragm receiving portion 48 and the switch receiving portion 52 of the cavity 46 presents an annular, counterbored edge surface 53. Edge surface 53 includes an annular, grooved, bead seat 54 for seating the diaphragm 22.

Cap 38 is threadably received on the central portion 36 of switch casing 12. An annular 0-ring seal 56 provides for a fluid tight connection between the switch body cap 38 and the central portion 36. A tubular member 58 extends axially inwardly from cap 38 to engage and position the electrical switch 28. Vent port 59 allows for fluid communication between the interior of tubular member 58 and the central cavity 46.

Electrical switch 28 includes a generally annular, non-conducting switch body 60. Switch body 60 includes support flange 62 for axially orientating the switch body 60 within the cavity 46 of the casing central portion 36. The flange 62 includes an annular, grooved bead seat 63. First and second electrical contacts 64, 66 are fixedly retained within switch body 60, and together comprise a first electrical contact 68. A shiftable metal cup 70 is received within a generally cylindrical retaining chamber 71 of switch body 60. The metal cup 70 comprises a second electrical contact 72 of the electrical switch 28.

Compression spring 74 biases the metal cup 70 and the electrical contacts 64, 66 into a non-contacting, open circuit position. A vent channel 76 provides for fluid communication between the chamber 71 defined by switch body 60 and cup 70, and the rest of the switching portion 26 of chamber 20. Tensioning cam 77 is received within the retaining chamber 71 of switch body 60. Cam adjustment screw 78 is threadably received by the cam 77 for axially adjusting the position of the cam 77 within the chamber 71, and thereby adjusting the tension of compression spring 74.

Diaphragm 22 comprises a gas permeable, non-conducting membrane 82 and an annular bead edge 84 integrally molded with the membrane 82. The bead edge 84 is received within the bead seat 54 of edge surface 53, and bead seat 63 of support flange 62. The membrane 82 isolates the actuating portion 24 from the switching portion 26 of the liquid tight chamber 20 defined by the switching device body 18. The gas permeable nature of the membrane 82, however, allows for equalization of pressure between the actuating portion 24 and switching portion 26 of the liquid tight chamber 20 over time.

Referring to FIG. 1 a clip 86 may be provided along the tubing 16 for detachably fixing the squeeze bulb 14 in proximity to a patient's hand.

In operation, the plug 30 of the signaling device 10 is inserted into the receptical of a signaling network. Unlike the prior art devices, signaling device 10 may be inserted into the receptical in any orientation, since the compression spring 74 maintains the first and second electrical contacts 68 and 72 in spaced apart, open circuit relationship, regardless of the vertical orientation of the first and second electrical contacts 68, 72 with respect to each other. The squeeze bulb 14 is positioned near a patient's hand on the patient's bed, and the clip 86 is attached to the bedcovers of the patient's bed to retain the squeeze bulb 14 in position.

When the patient desires to signal for assistance, squeeze bulb 14 is collapsed by the patient, thereby causing an overpressure in the actuating portion 24 of the liquid tight chamber 20 defined by the device body 18. The overpressure causes diaphragm 22 to collapse. The metal cup 70 is caused to shift against the biasing force of compression spring 74 and into abutting contact with the electrical contacts 64, 66.

When the squeeze bulb 14 is released by the patient, the bulb 14 will return to its uncollapsed position. The overpressure within the actuating portion 24 is thereby released, and the diaphragm 22 and metal cup 70 will be returned to their rest positions by the compression spring 74. Vent channel 76 provides for fluid communication between the internal chamber 71 formed by the metal cup 70 and switch body 60 and the remainder of the switching portion 26 of liquid tight chamber 20. The entire volume of the switching portion 26 of liquid tight chamber 20 is thereby available for accommodating the overpressure caused by collapsing the squeeze bulb 14, allowing for shifting of the diaphragm 22 with only a slight overpressure within the actuating portion 24 of the chamber 20. Since the diaphragm 22 is collapsable with only a slight overpressure within the actuating portion 24 of the liquid tight chamber 20, there is no need to vent the switching portion 26 of the liquid tight chamber 20 to the atmosphere. The signaling device 10 can therefore be totally immersed in a cleansing and sanitizing solution without damaging any of the internal parts of the signaling device 10.

I claim:

1. A pneumatically actuated, electrical contact signaling device, comprising:

a body defining an internal liquid tight chamber, said body including a switch casing generally defining a switching portion of said chamber, said switch casing including a central portion, a removable cap and means for connecting said cap to said central portion in a fluid tight fit, whereby said connected cap and central portion form a cavity means for compensating for said pneumatic actuation of said signaling device;

first and second electrical contact means received within a switching portion of said camber, said electrical contact means being shiftable between a first, mutually engaging, circuit closed position and a second mutually clearing, circuit open position;

biasing means for biasing said first and second electrical contact means into a predetermined one of said first or second positions;

pneumatic actuating means comprising an actuating portion of aid chamber, for selectively shifting said first and second electrical contact means against the urging of said biasing means, said pneumatic acting means including a deformable bulb operably coupled to said switch casing in fluid communicating relationship by pneumatic tubing; and a flexible diaphragm means for isolating said switching portion of said chamber from said actuating portion, said diaphragm means comprising a gas permeable membrane that allows for equalization of pressure between said actuating portion and said switching portion of said chamber over time.

2. The invention as claimed in claim 3, wherein said means for connecting said cap to said central portion of said switch casing comprises complementary threaded portions of said cap and said switch casing.

3. A pneumatically actuated, electrical contact signaling device, comprising:

a body defining an internal liquid tight chamber, said body including a switch casing generally defining a switching portion of said chamber, said switch casing including a central portion and a removable cap threadably received by said central portion in a fluid tight;

first and second electrical contact means shiftable between a first, mutually engaging, circuit closed position and a second, mutually clearing circuit open position;

biasing means for biasing said first and second electrical contact means into a predetermined one of said first or second positions whereby said electrical contact means are urged into said predetermined one of said positions irrespective of the orientation of said device;

pneumatic actuating means for selectively shifting said first and second electrical contact means into the other of said first or second positions against the urging of said biasing means, said pneumatic actuating means comprising a deformable bulb operably coupled to said switch casing in fluid communicating relationship by pneumatic tubing; and a nonconducting, gas permeable flexible diaphragm means for electrically isolating said first and second contact means from said actuating means, said diaphragm dividing said liquid tight chamber into an actuating portion said switching portion.

4. A pneumatically actuated, electrical contact signaling device, comprising:

a body defining an internal liquid tight chamber, said body including a switch casing generally defining a switching portion of said chamber, said switch casing including a central portion and removable cap threadably received by said central portion in a fluid tight fit;

first and second electrical contact means received within the switching portion of said chamber, said electrical contact means being shiftable between a first, mutually engaging, circuit closed position and a second, mutually clearing, circuit open position, said first electrical contact means comprising a pair of spaced apart electrical contacts carried by a nonconducting switch body, and said second electrical contact means comprising an electrically conducting element having sufficient length to extend across said switch body and simultaneously engage both of said electrical contacts when said first and second electrical contact means are in said first position, said switch body and said second electrical contact means defining a switch body internal chamber within said switching portion of said liquid tight chamber, said switch body including structure defining a vent channel for providing fluid communication between said switch body internal chamber and said switching portion of said liquid tight chamber;

biasing means comprising a compression spring interposed between said first and second electrical contact means for biasing said first and second electrical contact means into said second position;

pneumatic actuating means comprising an actuating portion of said chamber, for selectively shifting said first and second electrical contact means against the urging of said biasing means, said pneumatic actuating means including a deformable bulb operably coupled to said switch casing in fluid communicating relationship by pneumatic tubing; and a flexible diaphragm means for isolating said switching portion of said chamber from said actuating portion, said diaphragm means comprising a gas permeable membrane that allows for equalization of pressure between said actuating portion and said switching portion of said chamber over time.

5. A pneumatically actuated, electrical contact signaling device, comprising:

a body defining an internal liquid tight chamber having an actuating portion and a switching portion, said body including a switch casing having a central portion and a removable cap threadably received by said central portion in a fluid tight fit, said switch casing generally defining said switching portion of said chamber;

first and second electrical contact means shiftable between a first, mutually engaging, circuit closed position and a second, mutually clearing circuit open position, said first electrical contact means comprising a pair of spaced apart electrical contacts carried by a nonconducting switch body, and said second electrical contact means comprising an electrically conducting element having sufficient length to extend across said switch body and simultaneously engage both of said electrical contacts when said first and second electrical contact means are in said first position, said switch body and said second electrical contact means defining a switch body internal chamber within said switching portion of said liquid tight chamber, said switch body including structure defining a vent channel for providing fluid communication between said switch body internal chamber and said switching portion of said liquid tight chamber;

biasing means comprising a compression spring interposed between said first and second electrical contact means for biasing first and second electrical contact means into said second position irrespective of the orientation of said device;

pneumatic actuating means comprising a deformable bulb operably coupled to said switch casing in fluid communicating relationship by pneumatic tubing, said pneumatic actuating means for selectively shifting said first and second electrical contact means into said first position against the urging of said biasing means; and a nonconducting, gas permeable, flexible diaphragm means for electrically isolating said first and second contact means from said actuating means and for dividing said liquid tight chamber into said actuating portion and said switching portion.

* * * * *